United States Patent [19]

Judkins

[11] 4,248,424

[45] Feb. 3, 1981

[54] AERIAL PROJECTILE

[76] Inventor: Ren Judkins, 2260 Belair Dr., Salt Lake City, Utah 84109

[21] Appl. No.: 833,208

[22] Filed: Sep. 14, 1977

Related U.S. Application Data

[63] Continuation-in-part of Ser. No. 666,468, Mar. 12, 1976, abandoned.

[51] Int. Cl.[3] ..... A63B 43/02; A63B 37/06

[52] U.S. Cl. ..... 273/60 B; 273/65 EG; 273/417; 273/58 K; 273/428; 273/DIG. 20; 273/DIG. 7

[58] Field of Search ..... 46/79; 273/58 A, 199 R, 273/58 K, 60 B, 65 EG, 417, DIG. 20, DIG. 8, 428

[56] References Cited

U.S. PATENT DOCUMENTS

| | | | |
|---|---|---|---|
| 646,350 | 3/1900 | Breinl | 273/58 A |
| 2,718,644 | 9/1955 | Barr | 273/58 K X |
| 2,739,414 | 3/1956 | Cleveland | 46/79 X |
| 3,069,170 | 12/1962 | Dillon | 273/199 R |
| 3,724,123 | 4/1973 | Lemelson | 46/79 X |

FOREIGN PATENT DOCUMENTS

| | | | |
|---|---|---|---|
| 16231 | of 1910 | United Kingdom | 273/199 A |

*Primary Examiner*—George J. Marlo
*Attorney, Agent, or Firm*—H. Ross Workman; J. Winslow Young

[57] ABSTRACT

An aerial projectile including a skeletal shell and a baffling material confined and/or supported by the skeletal shell. The skeletal shell is fabricated from a resilient, durable, light-weight and deformation resistant material such as nylon or other suitable plastic. The skeletal shell is formed with a predetermined shape generally defining a spatial configuration which may be spherical, ovoidal, ellipsoidal, hemispherical, or the like. The baffling material is in the form of a lightweight, resilient material such as plastic foam or the like. The baffling material forms at least a part of the external contour of the aerial projectile and may even be used to form protruding vanes or fins for the aerial projectile.

13 Claims, 6 Drawing Figures

AERIAL PROJECTILE

This is a continuation-in-part application of my copending application Ser. No. 666,468 filed Mar. 12, 1976, now abandoned.

BACKGROUND

1. Field of the Invention

This invention relates to aerial projectiles and, more particularly, to aerial projectiles fabricated from a baffling material in combination with a skeletal shell to confine and support the baffling material.

2. The Prior Art

Numerous aerial projectiles are available in the art for sportive games and the like. These aerial projectiles include, for example, tennis balls, baseballs, footballs, basketballs, volley balls, badminton shuttle cocks, and others. Each of these aerial projectiles is configurated for a particular type of sportive game. The external configuration of the aerial projectile determines its flight pattern after being thrown or struck with a bat, racket, etc. However, due to the weight and streamlined profile, many of these prior art aerial projectiles traverse great distances at high rates of speed thereby requiring a playing field of extensive dimensions. Additionally, because of the hard, non-resilient surface, many of these aerial projectiles frequently cause serious accidental injuries and extensive damage to property.

In recognition of the foregoing problems associated with the playing of a conventional game such as baseball or football in a relatively limited spaced, various other aerial projectiles have been provided for the purpose of limiting the flight trajectory as well as providing a soft projectile surface. These include a simple homogenous foam ball, various types of shuttle cocks, and hollow plastic balls with or without holes in the surface. Unfortunately, these various prior art, low-flight aerial projectiles tend to be erratic in flight thereby greatly detracting from their utility in a sportive game. Additionally, a simple homogenous foam ball is easily damaged during rough usage, the damage generally tending to increase the erratic behavior of the aerial projectile in flight. In addition, none of the prior art devices can be readily adjusted to travel a shorter or a farther distance from a similar propelling impetus.

Additional prior art devices are disclosed in U.S. Pat. Nos. 646,350 and 3,069,170 as well as British Pat. No. 16,231. The playing ball illustrated in U.S. Pat. No. 646,350 is manufactured by winding a cotton yarn or other binding or fastening material around a required amount of sponge until an approximate spherical shape of a ball is attained. At an intermediate stage of manufacture, the partially formed ball includes portions of the sponge which project beyond and are not confined by the yarn. The ball is then pressed into a round shape by a suitable press until it has acquired the desired degree of elastic bounce, after which it is wound again until any portions of the sponge which may still project are completely covered and invisible. Thereafter, the ball is covered with the appropriate covering. If taken at the foregoing intermediate stage of manufacture, the playing ball would be entirely unsuitable for the purposes of the present invention particularly since the yarn material does not provide a suitable skeletal shell for the sponge so as to protect the sponge and resist deformation. Additionally, the yarn winding does not accommodate adjustment of the amount of sponge protruding from the ball to thereby suitably adjust the flight pattern of the aerial projectile.

The practice ball disclosed in U.S. Pat. No. 3,069,170 is fabricated as a spherical member from a sponge material which may be left in the substantially unfinished state with the sponge material exposed. The exposed sponge material may be suitably carved with small cup-like surface recesses, or the entire ball may be covered with a suitable covering. This practice ball likewise has no skeletal shell to protect the sponge material and, furthermore, there is no provision for selectively altering the flight characteristic of the practice ball.

The practice golf ball disclosed in British Pat. No. 16,231 is formed as a sphere of cork or the like. The cork may be protected with one or more equitorial or circumferential rings or rubber or similar material. The rings are sprung into peripheral grooves in the sphere and extend sufficiently above the surface thereof to receive and thereby cushion the blows of the golf club.

In view of the foregoing, it would be a significant advancement in the art to provide an aerial projectile which (a) combines the air resistance and impact cushioning of a baffling material such as a foam plastic with (b) a skeletal shell of durable, deformation resilient, lightweight material such as nylon or other suitable plastic, the combination (c) rendering an aerial projectile which flies true and is suitable for hard-hitting games in small areas. Such an invention is disclosed and claimed herein.

BRIEF SUMMARY AND OBJECTS OF THE INVENTION

The novel aerial projectile of the present invention incorporates a skeletal shell of resilient, resistant to deformation and lightweight plastic material which serves as a confining means and as a protectant for a lightweight baffling material such as plastic foam or the like. The skeletal shell is durable and distortion renitent and protects the baffling material against shearing under high impact forces while, inherently, providing a certain degree of mass for the aerial projectile. The skeletal shell has a plurality of openings through which some of the baffling material is exposed while the skeletal shell restrains the remainder or underlying baffling material. The baffling material may also be woven into the framework of the skeletal shell. The baffling material provides air resistance to retard the forward motion of the aerial projectile and impact absorption for safe play. The quantity of baffling material protruding through the openings in the skeletal shell may be selectively altered to thereby selectively alter the degree of wind resistance imparted to the aerial projectile by the exposed and protruded baffling material.

It is, therefore, a primary object of this invention to provide improvements in aerial projectiles.

Another object of this invention is to provide a new type of aerial projectile which is durable, safe, and inexpensive to manufacture.

Another object of this invention is to provide an aerial projectile which will travel a short range on an unperturbed trajectory in response to relatively large impulses.

Another object of this invention is to provide an aerial projectile which may be readily adjusted to travel further or shorter distances from a similar impetus.

Another object of this invention is to provide an improved method for selectively controlling the flight trajectory of an aerial projectile.

These and other objects and features of the present invention will become more fully apparent from the following description and appended claims taken in conjunction with the accompanying drawing.

DETAILED DESCRIPTION OF THE PREFERRED EMBODIMENTS

Figure 1:
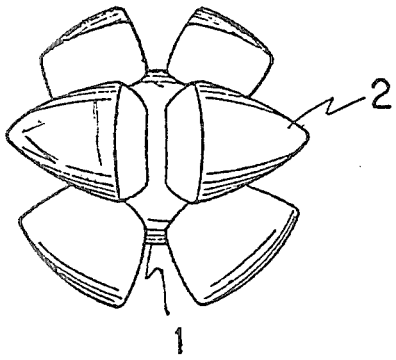
FIG. 1 is a side elevation of a first preferred embodiment of the aerial projectile of this invention.

The invention is best understood by reference to the drawing wherein like parts are designated with like numerals throughout.

GENERAL DISCUSSION

The aerial projectile of this invention is configurated as a generally two component projectile including (a) an exoskeletal framework or skeletal shell and (b) a baffling material contained by and/or supported on the skeletal shell. The skeletal shell encompasses a space and is configurated as an exoskeletal-like structure which is retiform, interspacial, or otherwise provided with openings therein for air and/or baffling material to pass through. The skeletal shell may be fabricated of any suitable, durable, lightweight material that is resistant or resilient to deformation.

The skeletal shell has several primary functions which include, for example, (1) providing a framework that (a) supports and (b) restrains a baffling material in a given configuration, (2) serving as a guide for protruding vanes or baffling material in a predetermined configuration, (3) serving as a warp for the baffling material to be wrapped or otherwise woven around, as desired, and (4) containing or otherwise holding together all of the parts of the whole. The skeletal shell also holds the protruding "fingers" in their spatial relationship to accommodate air entry into the interstices between the fingers during flight, the air assisting the fingers in returning to their original configuration after impact or deformation. Additionally, another function of the skeletal shell is to contribute resistance or resilience to deformation of the overall projectile shape especially during and after hitting or throwing when suitable recovery of the symmetry of the aerial projectile is necessary for a simple, true trajectory. Finally, the skeletal shell provides protection to the baffling material against shearing, for example, when the aerial projectile is struck on the rim of a racket or the like so as to enhance the overall durability of the aerial projectile of this invention.

The baffling material's primary functions are (1) to absorb impact energy and (2) decelerate the aerial projectile by means of air resistance. The absorption of impact energy is especially important for games using a racket or bat as a means for impelling the aerial projectile. The baffling material cushions the impulse so that the distance travelled relative to the power of blow is smaller for any given aerial projectile. As for air resistance, the projectile is slowed down by giving up energy to the air through friction, compression and momentum imparted to the air by the exposed baffling material.

Some examples of possible baffling material are: coated spun fiberglass, batting, reticulated plastic foam, plastic foam, and the like. The plastic foams are particularly suitable materials for use in the practice of this invention.

The plastic foam material provides many advantages in addition to being lightweight and providing the appropriate air resistance. The self-supporting features of the plastic foam material are advantageously utilized in certain of those aerial projectile configurations wherein the plastic foam material protrudes beyond the external profile of the skeletal shell. Under these conditions, the protruding plastic foam material construction greatly increases the air-resisting surface area to weight ratio of the aerial projectile. Additionally, the protruding plastic foam material cushions the aerial projectile upon impact and, due to its inherent resilience, quickly returns to its original shape after impact. Additionally, the air resistance encountered by the aerial projectile after initial impact quickly assists the foam in returning to its original configuration.

The plastic foam material useful for the various aerial projectiles illustrated in this invention can be fabricated from a single piece or a plurality of pieces of plastic foam material. Accordingly, the skeletal shell serves an additional function of serving as a containment means for constraining pieces of plastic foam material into the desired configuration while allowing the plastic foam material to be exposed through the openings of the skeletal shell in such a way that the baffling material absorbs impact energy and provides deceleration via air resistance and is assisted by the air in returning the baffling material to its original shape. The skeletal shell thereby forms a framework to support, restrain, and contain the baffling material while giving structural deformation resistance, resilience and durability to the aerial projectile. The skeletal shell also acts to receive a portion of the initial impact and thereby distribute these impact forces to the aerial projectile to control the degree of deformation thereof and thereby control the shape of the aerial projectile.

The self-supporting characteristics of the plastic foam material also readily accommodate the fabrication of an aerial projectile having a plurality of external configurations including (a) a spherical shape wherein the plastic foam baffling material protrudes symmetrically through the openings in the skeletal shell and (b) fins or a cone of vanes of the plastic foam baffling material nonsymmetrically protruding out of the shell in such a manner as to form a drogue-like member for the aerial projectile. The fins or vanes thereby contribute to controlling the flight pattern of the aerial projectile.

With the baffling material provided in the form of strips of plastic foam material or the like, the aerial projectile may be fabricated by wrapping or weaving the baffling material through and around the rib members of the skeletal shell. In this configuration, the skeletal shell serves as a warp and as a support structure for the baffling material. Under these conditions, the aerial projectile so fabricated is generally hollow with the skeletal shell and the interwoven baffling material forming the surface structure of the aerial projectile thus configurated.

THE EMBODIMENT OF FIG. 1

Referring now more particularly to FIG. 1, a first preferred embodiment of the aerial projectile of this invention is illustrated and includes a skeletal shell 1 having a plurality of protrusion of baffling material 2 protruding therefrom. Skeletal shell 1 is configurated as a hollow, basically spherical ball with a plurality of openings (not shown) through which the baffling material 2 protrudes.

Baffling material 2 is specifically configurated to protrude substantially beyond the external periphery or profile of skeletal shell 1 to thereby provide the external profile of the aerial projectile of FIG. 1. The baffling material 2 is fabricated from a plastic foam material which is confined internally by skeletal shell 1 and protrudes outwardly through the openings in skeletal shell 1 in a symmetrical pattern generally corresponding to the spherical shape of skeletal shell 1. Under these conditions, the self-supporting features of the plastic foam for baffling material 2 are placed to advantage as set forth hereinbefore by providing the external profile of the aerial projectile. This type of construction substantially increases the air resisting surface area to weight ratio, cushions impact, and has air assisted recovery of shape after impact. It should further be noted that the baffling material 2 can be fabricated in the form of a single piece or a plurality of pieces, a portion of each piece protruding from skeletal shell 1. Additionally, the protrusions of baffling material renders the aerial projectile soft to catch because of the exposed baffling material 2. The protruding baffling material 2 also aids in gripping the aerial projectile.

In combination, the properties of the skeletal shell 1 and the baffling material 2 can be suitably balanced to meet the requirements for different games. Balancing of the properties of the skeletal shell 1 and the baffling material 2 can be in the form of the amount of protrusion of baffling material 2 through the openings of skeletal shell 1. Accordingly, in order to adjust the trajectory of the aerial projectile of FIG. 1, the player (not shown) may suitably alter the degree of protrusion of baffling material 2 beyond the external profile of skeletal shell 1 thereby suitably increasing or decreasing the decelerating effect of baffling material 2 imparted to the aerial projectile of FIG. 1. For this purpose, the synthetic foam material is highly advantageous since it is inherently compressible and readily accommodates being compressed and portions stuffed inside the hollow of skeletal shell 1.

Figure 2:
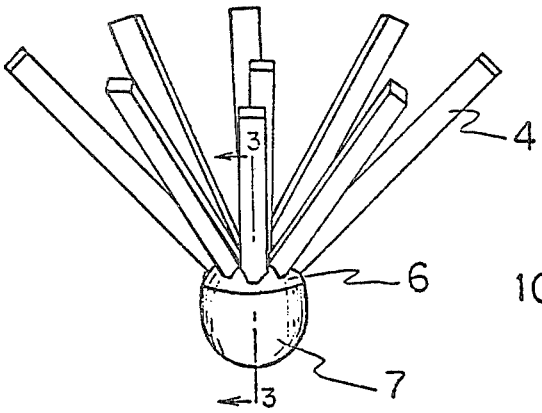
FIG. 2 is side elevation of a second preferred embodiment of the aerial projectile of this invention.
Figure 3:
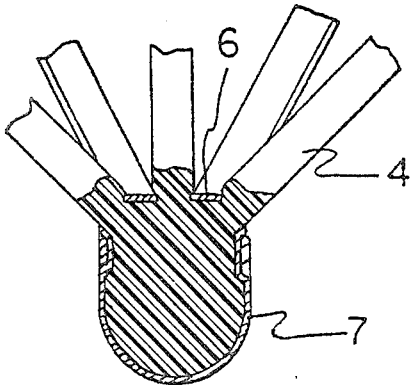
FIG. 3 is a partial cross-section taken along lines 3—3 of FIG. 2 with portions broken away for ease of illustration.

THE EMBODIMENT OF FIGS. 2 and 3

Referring now more particularly to FIGS. 2 and 3, a second preferred embodiment of the present invention is illustrated wherein a skeletal shell 6 is configurated as a nonsymmetrical body with a plurality of symmetrically oriented openings therethrough. A plurality of fins or vanes 4 of baffling material extend outwardly a substantial distance from the skeletal shell 6.

A rubber nose 7 is attached to the forward end of skeletal shell 6 to completely encapsulate additional baffling material therein. In this configuration, the aerial projectile of FIGS. 2 and 3 is configurated substantially similar to a shuttlecock with the exception that the "feathers" of the conventional shuttlecock are now in the form of the fins or vanes 4. In the configurations illustrated herein, skeletal shell 6 serves as a framework that supports and restrains the baffling material in the given configuration. Additionally, skeletal shell 6 serves as a basal framework for attachment of rubber nose 7.

In this particular configuration, the self-supporting features of the plastic foam material useful in this invention are advantageously utilized since the plastic foam baffling material protrudes a substantial distance beyond the external profile of skeletal shell 6 in the form of vanes 4. This type of construction greatly increases the air resisting surface area to weight ratio of the aerial projectile while rubber nose 7 encloses a body of baffling material and thereby substantially cushions impulse impacts. The inherent resilience of the plastic foam material also substantially assists in the air-assisted recovery of the shape of the aerial projectile after impact.

THE EMBODIMENT OF FIGS. 4 AND 5

Figure 4:
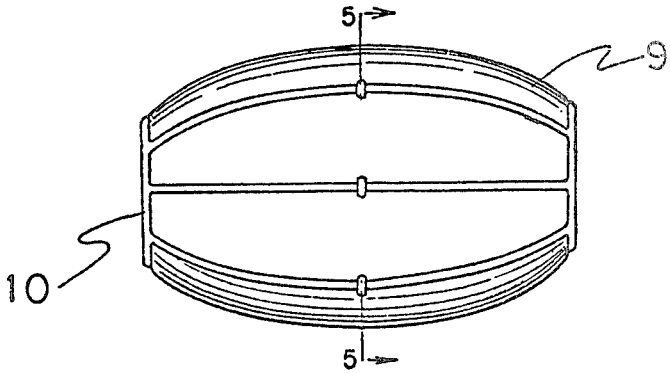
FIG. 4 is a side elevation of a third preferred embodiment of the aerial projectile of this invention.
Figure 5:
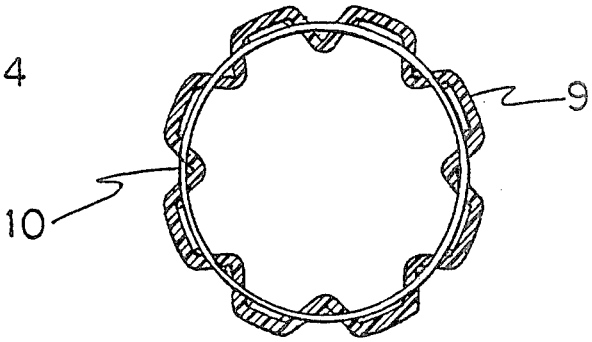
FIG. 5 is a cross-section taken along lines 5—5 of FIG. 4.

Referring now more particularly to FIGS. 4 and 5, the aerial projectile illustrated herein is in the overall shape of an ellipsoid ball (football-shape) to serve as a football in games similar to its namesake. The aerial projectile illustrated herein includes a skeletal shell 10 which serves as a base or warp for strips of baffling material 9 interwoven therewith. It will be noted from FIG. 5 that the external profile of the aerial projectile is formed primarily from the baffling material 9 which, in turn, is supported by the framework or skeletal shell 10. The skeletal shell 10 thereby forms a framework to support, restrain and contain the baffling material 9 while giving structural integrity, deformation resilience and durability to the aerial projectile. In addition, skeletal shell 10 allows the aerial projectile to be easily thrown since skeletal shell 10 aids in gripping the aerial projectile or football formed thereby.

The combination of the properties of skeletal shell 10 and baffling material 9 can also be suitably balanced to adjust the aerial projectile to meet the requirements of different types of games since baffling material 9 tends to absorb impact energy and to decelerate the aerial projectile via air resistance. Accordingly, when the aerial projectile illustrated in FIGS. 4 and 5 is utilized for a football-type game, the game can be readily adapted to be played in a substantially smaller area since the properties of the aerial projectile can be readily balanced to meet the requirements for the particular game. The baffling material 9 cushions the throwing impulse so that the distance travelled by the aerial projectile relative to the power of the throw is smaller for any given aerial projectile. Additionally, the baffling material 9 slows the projectile down by giving up energy to the air through friction, compression, and momentum imparted to the air by the exposed baffling material 9. In addition, the baffling material 9 renders the aerial projectile soft to catch because of the surface area of the baffling material 9.

THE EMBODIMENT OF FIG. 6

Figure 6:
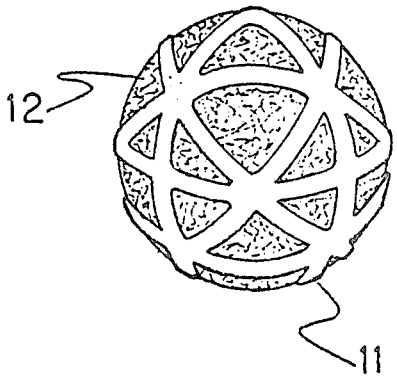
FIG. 6 is a side elevation of a fourth preferred embodiment of the aerial projectile of this invention.

Referring now more particularly to FIG. 6, a fourth preferred embodiment of the present invention is shown herein having a skeletal shell 11 which is substantially more cribiform to contain the baffling material 12 therein when the baffling material 12 is less cohesive than the reticulated or plastic foam material of this invention and thereby requires more containment. In combination, the properties of the skeletal shell 11 and the baffling material 12 can be suitably balanced to meet the requirements of many different games. For instance, if the aerial projectile of FIG. 6 is used as a baseball in a game similar to its namesake, the aerial projectile can be readily adapted to be played in a smaller area. For example, the skeletal shell 11 encompasses a space and has an exoskeletal-like structure which is retiform, interspacial or otherwise provided with a plurality of openings for baffling material 12 to be exposed therethrough. The skeletal shell can be made of any suitable lightweight material that is resistance or resilient to deformation while, simultaneously, forming a framework that supports and restrains the baffling material 12 in the given configuration.

In its configuration, therefore, skeletal shell 11 serves as a containment means to contain or hold together all the parts of the whole while contributing resistance or resilience to deformation of the overall profile or shape of the aerial projectile, especially during and after hitting or throwing when recovery of the symmetry of the aerial projectile is necessary for a simple, true trajectory. Skeletal shell 11 also protects baffling material 12 against shearing, for example, when struck on the rim of a racket or the like and thereby enhances the overall durability of the aerial projectile. The skeletal shell 11 may be readily fabricated from any suitable synthetic resin material such as nylon or other suitable plastic. The surface structure of skeletal shell 11 is minimized in order to maximize the openings for exposure of the baffling material 12 and to reduce weight. The size and number of the openings in skeletal shell 11 may be suitably adjusted to contain the baffling material 12 in the event the baffling material is less cohesive than a plastic foam and thereby requires additional containment.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for selectively controlling the flight trajectory of an aerial projectile comprising the steps of:

forming a skeletal shell for the aerial projectile, the skeletal shell generally defining a three-dimensional configuration of the aerial projectile;

confining within said shell a body of resilient, highly flexible plastic foam which serves as baffling material to increase wind resistance to the flight of said projectile and to cushion the impact of said projectile;

providing a plurality of openings in the skeletal shell so as to permit portions of said baffling material to protrude through said openings substantially beyond the periphery of said shell, thereby increasing the wind resistance to said projectile during flight providing an impact absorbent periphery; and altering the flight pattern of the aerial projectile by adjusting the amount of baffling material which protrudes from said openings so as to selectively alter the degree of wind resistance imparted to the aerial projectile by the protruded and exposed baffling material.

2. An aerial projectile comprising in combination:

a resilient, highly flexible plastic foam which serves as baffling material to effectively increase wind resistance to said projectile's flight; and a shell formed from resilient material which resists deformation after impact, said shell encircling said baffling material and having a plurality of openings formed therein through which portions of said baffling material protrude substantially beyond the periphery of said shell to increase wind resistance to said projectile's flight.

3. An aerial projectile as defined in claim 2 wherein said shell is essentially spherical in configuration and said openings are essentially symmetrically oriented about the periphery of said shell.

4. An aerial projectile as defined in claim 2 wherein said openings are sufficiently large in relation to the overall periphery of said shell that said protruding baffling material substantially obscures said shell by forming a second periphery about said shell.

5. An aerial projectile as defined in claim 2 wherein said shell forms a hollow that essentially encloses said baffling material except for said openings.

6. An aerial projectile as defined in claim 2 wherein said shell comprises a first portion which completely encloses said baffling material and a second portion having openings formed therein from which said baffling material protrudes substantially beyond the periphery of said shell.

7. An aerial projectile as defined in claim 6 wherein said baffling material extends radially through said openings in long, finger-like projections so as to function as flight vanes, in the manner of a shuttlecock.

8. An aerial projectile as defined in claim 7 wherein said first portion of said shell is separable from said second portion of said shell.

9. An aerial projectile as defined in claim 2 wherein said shell comprises a plurality of individual bands forming a framework for said baffling material.

10. An aerial projectile as defined in claim 9 wherein said baffling material is interwoven with said bands of said framework.

11. An aerial projectile as defined in claim 10 wherein said framework is configurated in an elongated, generally football-like shape and wherein said bands are connected together at a plurality of joints.

12. An aerial projectile as defined in claim 11 wherein said baffling material is supported by said bands of said framework so as to form a hollow space which extends longitudinally through said framework and the baffling material supported thereon.

13. An aerial projectile comprising in combination:

a resilient, highly flexible plastic foam which serves as baffling material to effectively increase wind resistance to said projectile's flight; and a shell formed from resilient material which resists deformation after impact, said shell having an essentially spherical configuration and encircling said baffling material, said shell further having a plurality of openings through which portions of said baffling material protrude substantially beyond the periphery of said shell to increase wind resistance to said projectile's flight, said openings being essentially symmetrically oriented about the periphery of said shell and said openings further being of sufficient size in relation to the overall periphery of said shell that said baffling material protrudes sufficiently beyond the periphery of said shell to substantially form a second impact absorbent periphery about said shell.

* * * * *